United States Patent [19]

Meyer, IV et al.

[11] Patent Number: 4,880,052

[45] Date of Patent: Nov. 14, 1989

[54] HEAT PIPE COOLING PLATE

[75] Inventors: George A. Meyer, IV, Conestoga; Robert F. Coleman, Lancaster, both of Pa.

[73] Assignee: Thermacore, Inc., Lancaster, Pa.

[21] Appl. No.: 316,407

[22] Filed: Feb. 27, 1989

[51] Int. Cl.[4] ..... F28D 15/02

[52] U.S. Cl. ..... 165/104.14; 29/157.3 H; 165/104.26

[58] Field of Search ..... 165/104.14, 104.26; 29/157.3 H

[56] References Cited

U.S. PATENT DOCUMENTS

| | | | |
|---|---|---|---|
| 3,152,774 | 10/1964 | Wyatt . | |
| 3,429,122 | 2/1969 | Pravda . | |
| 3,450,195 | 6/1969 | Schnacke . | |
| 3,749,156 | 7/1973 | Fletcher | 165/104.26 |
| 4,118,756 | 10/1978 | Nelson . | |
| 4,231,423 | 11/1980 | Haslett . | |
| 4,602,679 | 7/1986 | Edelstein . | |

FOREIGN PATENT DOCUMENTS

| | | | |
|---|---|---|---|
| 86390 | 5/1983 | Japan | 165/104.14 |
| 9192 | 1/1987 | Japan | 165/104.26 |

OTHER PUBLICATIONS

Basiulis et al, A *Improved Reliability of Electronic Circuits Through The Use of Heat Pipes,* 37th National Aerospace and Electronics Conf., Dayton, Ohio, 5/1985 (p. 5).

*Primary Examiner*—Albert W. Davis, Jr.
*Attorney, Agent, or Firm*—Martin Fruitman

[57] ABSTRACT

A flat cooling plate which is assembled with individual heat pipes which are annealed, flattened tubes with sintered wicks formed within them. The completely constructed and pre-tested heat pipes are set into slots in a spacer plate which is sandwiched between two unslotted flat sheets. For assembly, bonding material is placed between the slotted plate and unslotted sheets, and the assembly is heated to the bonding material working temperature while compressed in a press in order to prevent damage from excessive internal heat pipe pressure.

6 Claims, 2 Drawing Sheets

HEAT PIPE COOLING PLATE

SUMMARY OF THE INVENTION

This invention deals generally with heat transfer and more specifically with a cooling plate assembly constructed from individual heat pipes.

A thin cooling plate is a valuable subassembly in many heat transfer applications. It can be used to transfer heat from one edge to another, from one face to the opposite face, or from one face to an edge. In the simplest form, a cooling plate can merely be a copper sheet which separates two fluids and transfers heat between them across its thickness.

However, for heat transfer from edge to edge of a plate or from a face to an edge, simple sheets of heat conductive material are not always satisfactory. The very configuration of the thin plate counteracts effective heat transfer when heat transfer must occur in a direction parallel to the plane of the plate. In that direction the small cross sectional area and long heat path make heat transfer more difficult.

For heat transfer applications which require heat flow parallel to the surface of plates, heat pipes have sometimes been used.

U.S. Pat. Nos. 3,450,195 to Schnacke and 4,118,756 to Nelson et al show two typical approaches to cooling plate assemblies which include heat pipes. Schnacke forms the plate from individual identical heat pipes which are assembled adjacent to each other to form the panel. Nelson et al, on the other hand, build a single heat pipe with multiple interconnected branches.

Each of these devices has certain problems. The assembly of multiple individual heat pipes, whether made from a single sheet surface and compartmentalized or made from individual heat pipes which are attached to each other, is always expensive and complex. The individual heat pipes must be constructed to close tolerances so that they will fit together, and if a truly flat surface is required, the tolerance and assembly problems are made much worse.

The single heat pipe with multiple branches has similar cost and tolerance problems, but also adds problems of its own. The interconnection of the branches means that a failure of one branch disables the entire assembly. This generally leads to the use of thicker walls to prevent structural failure, but even that can not prevent a weak assembly joint from failing and disabling the entire assembly. Moreover, when, as in Nelson et al, the entire periphery of the assembly has a joint which is subject to the vapor pressure of the heat pipe, the odds are greater that a failure will occur.

Problems from the requirements for close tolerances and leak tight assembly have limited heat pipe cooling plates to high cost projects such as space applications. Moreover, even in such applications where cost may be less of a problem, the heat pipes can not be tested until the entire assembly is completed. A test failure at such a time greatly increases costs and can delay project completion.

The present invention offers a solution to the high cost and low reliability of prior heat pipe cooling plates, because it uses pre-assembled, pre-tested individual heat pipes which, only after their integrity has been assured, are assembled into a simple, low cost cooling plate. Furthermore, the assembly procedure requires no strict tolerances and not only does not jeopardize the integrity of the heat pipes, but adds to their strength and reliability. Finally, the heat pipe casing and sheet material thickness used can be thin enough in the present invention so that heat transfer across the wall thickness has little effect on the operation of the cooling plate.

The present invention also uses relatively few parts. The number of individual heat pipes required varies, of course, with the size of the plate, but other than the heat pipes, the assembly requires only five other parts. These are two surface sheets, a slotted spacer plate and two sheets of solder to bond the assembly together.

The individual heat pipes themselves are also quite simple. Although their casings can be formed into near rectangular cross section, the simplest construction of the preferred embodiment uses flattened thin walled, low mass, copper tubing within which is formed a sintered capillary wick. To build the heat pipes, the casing is cut to the length desired, the wick is sintered within the casing, the ends are formed, air is evacuated from the casing, working fluid loaded in and the casing sealed. The construction of simple, similar heat pipes of this sort, using, for instance, water as a working fluid is well established in the art. The heat pipe of the preferred embodiment differs significantly only in that its casing is of flattened tubing so that more surface will be available for intimate contact with the surface sheets of the cooling plate of the present invention and that its casing has been annealed during the wick sintering process.

After individual flattened casing heat pipes are constructed, they may be fully tested in all respects. This can typically include not only operational testing to verify that each heat pipe will operate initially, but can also include verification of the pressure integrity of each casing.

While heat pipes which fail testing are likely repairable, even if they are discarded, it is important to note that such production losses are at an early stage of production and are far less costly than discovering a completed assembly which will not meet specifications.

Using the pre-assembled and pre-tested heat pipes as key components, the heat pipe cooling plate is then assembled by a process which preserves the integrity of the heat pipes and assures flat surfaces for the finished cooling plate.

The assembly process is essentially one which is best thought of as building a sandwich which has flat full surface sheets as its outermost parts. In later use it is these surfaces to which there will likely be attached electronic components which require cooling. A liquid or air cooled housing is then attached to an edge near which all the heat pipes terminate, and the entire cooling plate is thereby maintained at or very near the temperature of the cooled housing.

The sandwich of the heat pipe cooling plate during construction consists of five layers. The two outermost layers are, as noted above, the flat, continuous surface sheets. They are usually of cooper, aluminum or some other heat conductive material and are preferrably of as thin a sheet as is structurally practical in order to aid in heat transfer across their thickness.

The middle layer of the construction sandwich is a slotted plate. The plate thickness should, taking into account manufacturing tolerances, be the same as the outside dimension of the heat pipes from one flat surface to the other. There are slots in the center plate for the heat pipes of the cooling plate assembly and the widths ,and lengths of the slots are dimensioned with clearance for the heat pipes to fit into them, with the flat surfaces of the heat pipes in approximately the same planes as the larger surfaces of the slotted plate.

During assembly of the sandwich, a solder sheet or some other bonding material is placed between the layer with the slotted plate and heat pipes and each outermost surface sheet. Of course, the melting and flow temperatures of the solder of which the solder sheets are made must be safely above the working temperature of the finished heat pipe cooling plate to prevent failure of the cooling plate during later use.

However, subjecting the thin walled annealed heat pipes and the surface sheets to the required solder flow temperature during assembly can also cause a problem. Since the solder flow temperature is likely to be substantially above the heat pipe working temperature, the internal pressure of the heat pipes during this heating step will also be substantially greater than their design working pressure. For the preferred thin wall construction, the excessive pressure is likely to cause ballooning out of the flat surfaces of the heat pipes and, in turn of the thin surface sheets adjacent to the heat pipes.

The method of the present invention, therefore, requires that, during the soldering or any other heating operation and until cooled sufficiently to reduce the vapor pressure, the sandwich assembly be held in a press which produces forces against the flat surface sheets, and thereby also against the heat pipes, to prevent any distortion.

With such an assembly method, the thin walled individual heat pipes can be properly assembled into the cooling plate, and the flowing solder not only structurally bonds the parts together but also fills any voids between the heat pipes and the surface sheets and slotted spacer plate, thus enhancing heat transfer and increasing the structural strength of the heat pipes.

DETAILED DESCRIPTION OF THE INVENTION

Figure 1:
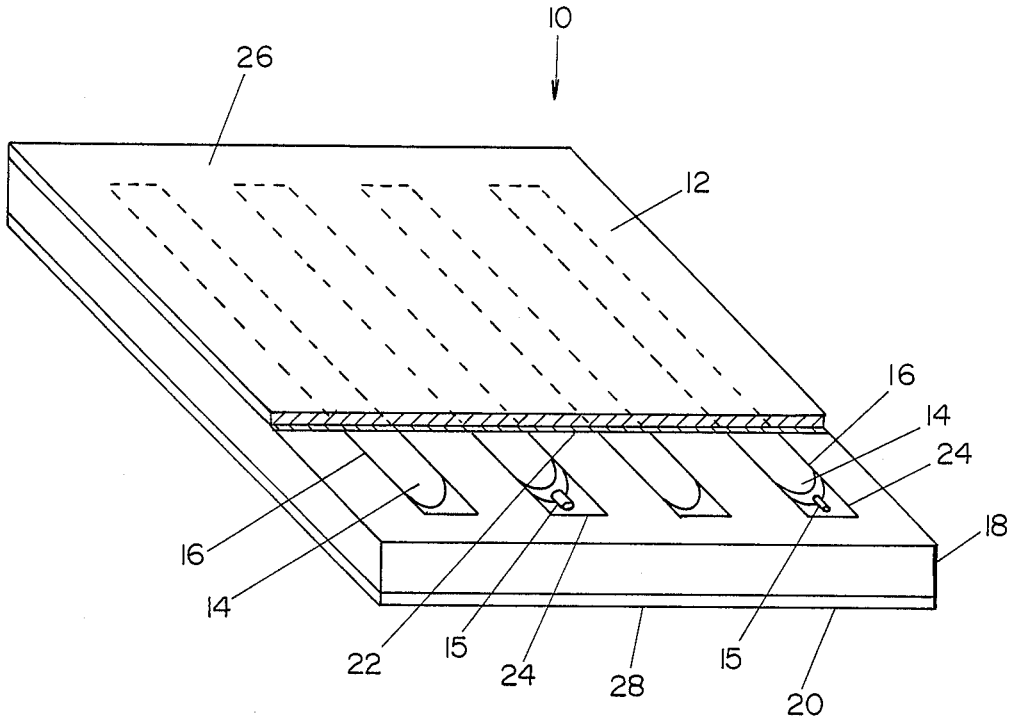
FIG. 1 is a perspective view of the heat pipe cooling plate of the preferred embodiment of the invention with one surface sheet partially cut away.

The preferred embodiment of the invention is shown in FIG. 1 in which heat pipe cooling plate 10 is shown in a perspective view with its upper surface sheet 12 cut away for a better view of the internal construction.

In FIG. 1 heat pipes 14 are located within slots 16 within spacer plate 18. Flattened heat pipes 14 form an essentially continuous surface with spacer plate 18 on both the upper and lower surface of spacer plate 18.

Upper surface sheet 12 and lower surface sheet 20 are attached to the surfaces of heat pipes 14 and spacer plate 18 by solder 22 which also fills in space 24 within slots 16 which is not occupied by heat pipes 14 and thereby also bonds heat pipes 14 to spacer plate 18. Thus, once cooling plate 10 has been raised above the flow temperature of solder 22 and then cooled, the entire assembly becomes one solid piece with heat pipes 14 imbedded within it.

In a typical application electronic components (not shown) are attached to upper surface sheet 12 or lower surface sheet 20, and a cooled housing (not shown) is attached to ends 26 or 28 of cooling plate 10 which are near the ends of heat pipes 14. Since heat pipes 14 maintain an essentially uniform temperature over their entire length, the entire volume of cooling plate 10 is thereby maintained at a temperature only slightly higher than the temperature of the cooled housing, thus furnishing a near perfect heat sink for the electronic components.

FIG. 1 also shows the heat pipes arranged to minimize the slight discontinuity in heat transfer caused by fill tubes 15 which are essentially extensions of the heat pipe casing located at the end of each heat pipe 14. In order not to accumulate all these discontinuities in one region, heat pipes 14 are positioned within slots 16 in alternate directions so that only every other slot end has the additional empty space around fill tube 15

Figure 2:
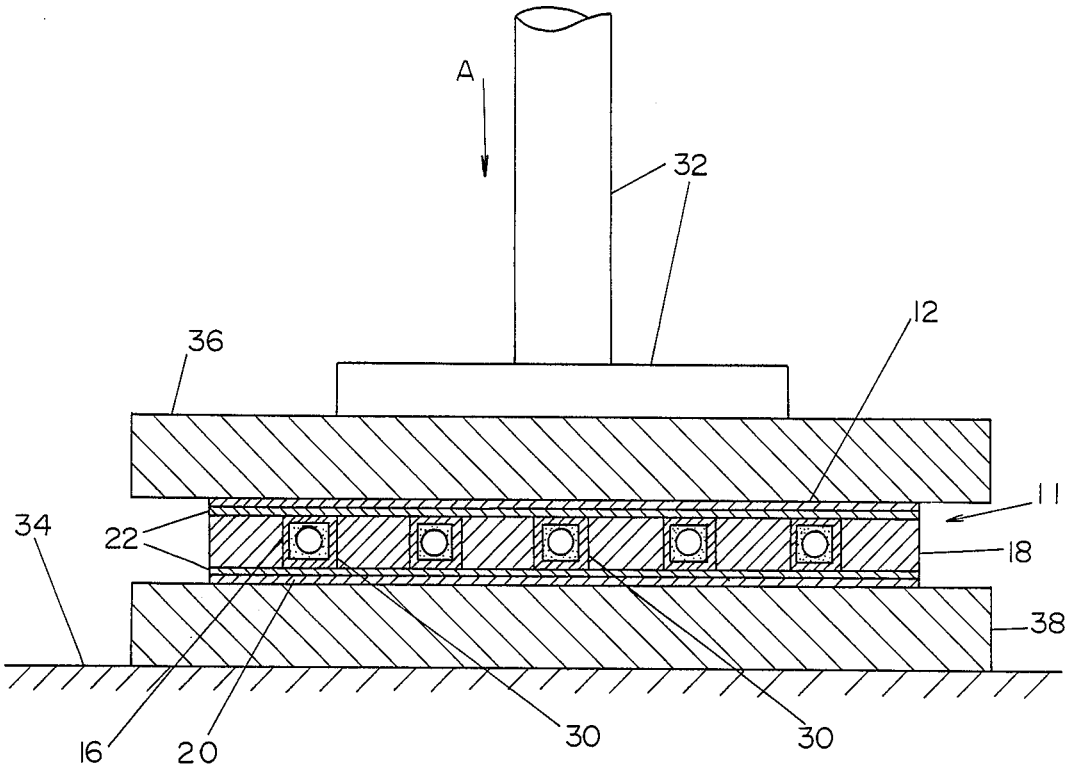
FIG. 2 is a cross section view of an alternate embodiment of the invention during construction of the invention.

FIG. 2 is a cross section view of an alternate embodiment of the invention which uses rectangular cross section heat pipes within slots 16 of spacer plate 18. FIG. 2 also shows press 32 which is used to apply force A against table 34 in order to compress cooling plate 11 between flat plates 36 and 38 to assure that high vapor pressure within heat pipes 30 will not distort their casings and wick structure and also does not distort upper surface sheet 12 or lower surface sheet 20.

Compression force A is maintained at a pressure in excess of the vapor pressure of heat pipes 30 upon cooling plate 10 during the time when it is at a temperature significantly above its operating temperature because the higher temperature required to melt and cause solder 22 to flow also increases the vapor pressure within heat pipes 30. This increased vapor pressure would likely distort the casings of heat pipes 30 and bulge surface sheets 12 and 20 if flat plates 36 and 38 were not held in place against cooling plate 11 by press 32. It is the procedure of clamping heat pipe cooling plate 11 in press 32 between flat plates 36 and 38 that maintains the flatness and structural integrity of cooling plate 11 during the soldering process. Once the temperature to which cooling plate 11 is subjected is lowered t approximately its normal operating temperature, cooling plate 11 can be released from press 32 with no danger of distortion.

The present invention therefore furnishes a simple, highly reliable, heat pipe cooling plate and a method of constructing it.

In one embodiment of the invention it has been possible to construct a heat pipe cooling plate with water as a heat pipe fluid and heat pipe casings with wall thicknesses in the range of 0.001 to 0.015 inches while soldering the assembly at temperatures up to 190° C. which produces vapor pressures up to 200 p.s.i. These assemblies can be constructed with heat pipe materials such as aluminum or annealed cooper, which are traditionally considered too weak to be soldered at such temperatures once sealed with liquid within them.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims. For instance, heat pipes 14 and 30 could be constructed by any means, be of various shapes and include wick structures other than sintered wicks. Moreover, solder paste, high temperature curing epoxy or diffusion bonding could be used instead of solder sheets.

Furthermore, flux could be added in the assembly procedure or some parts could be plated beforehand.

What is claimed as new and for which Letters Patent of the United States are desired to be secured is:

1. A thin walled cooling plate comprising a spacer plate within which is formed at least one slot which penetrates the thickness of the spacer plate from a first larger surface through to the opposite larger surface of the spacer plate;

at least one individual, pre-assembled, heat pipe locate within a slot in the spacer plate, each heat pipe having two essentially flat surfaces which are parallel to each other, with the outside dimension of the parallel surfaces being approximately equal to the thickness dimension of the spacer plate and each heat pipe essentially flat surface located approximately in the plane of a larger surface of the spacer plate, the strength of the casing of the heat pipe being less than that required to prevent its distortion by the vapor pressure produced within the heat pipe during the assembly of the cooling plate;

a first surface sheet attached with bonding means to the first larger surface of the spacer plate and to the heat pipe surfaces in approximately the same plane as the first larger surface of the spacer plate, the strength of the first surface sheet being less than that required to prevent is distortion by the vapor pressure of the heat pipe during assembly of the cooling plate; and a second surface sheet attached with bonding means to the opposite larger surface of the spacer plate and to the heat pipe surfaces approximately in the same plane as the opposite larger surface of the spacer plate.

2. The thin walled cooling plate of claim 1 wherein the bonding means are solder sheets.

3. The thin walled cooling plate of claim 1 wherein the bonding means is high temperature curing epoxy.

4. The thin walled cooling plate of claim 1 wherein the bonding means is diffusion bonding.

5. The thin walled cooling plate of claim 1 wherein the heat pipes in adjacent slots are oriented with their fill tubes at opposite ends of the adjacent slots.

6. A method of constructing a heat pipe cooling plate comprising:

constructing at least one operating heat pipe which has two flat surfaces on the outside of its casing with the flat surfaces parallel to each other;

fabricating a spacer plate with a thickness equal to the outside dimension of the flat parallel surfaces of the heat pipes, and with at least one slot within the spacer plate into which the heat pipes will fit;

placing a first surface sheet of the same width and length as the spacer plate on a first flat plate;

placing a first bonding material on the first surface sheet;

placing a spacer plate on the bonding material on the first surface sheet;

placing at least one pre-constructed heat pipe within at least one slot in the spacer plate;

placing a second bonding material material on the spacer plate;

placing a second surface sheet of the same length and width as the spacer plate on the bonding material on the spacer plate;

placing a second flat plate on the second surface sheet;

exerting a compression pressure on the first and second flat plates and the parts between them, the pressure being greater than the vapor pressure of fluid in the heat pipes at the bonding temperature of the bonding material;

heating all the parts, while they are under compression, to the bonding temperature of the bonding materials for a time sufficient to cause the assembly to be bonded;

cooling all the parts; and removing the compression pressure.

* * * * *